US006214417B1

(12) United States Patent
Watanabe et al.

(10) Patent No.: US 6,214,417 B1
(45) Date of Patent: Apr. 10, 2001

(54) CLOTH FOR INK-JET PRINTING, METHOD OF FABRICATING SAME, AND METHOD OF INK-JET PRINTING SAME

(75) Inventors: Ichiei Watanabe; Saiko Yamada; Naohiro Oobayashi; Hiroyuki Makita, all of Fukui (JP)

(73) Assignee: Seiren Co., Ltd., Fukui (JP)

( * ) Notice: Subject to any disclaimer, the term of this patent is extended or adjusted under 35 U.S.C. 154(b) by 0 days.

(21) Appl. No.: 09/113,915

(22) Filed: Jul. 10, 1998

(30) Foreign Application Priority Data

Jul. 12, 1997 (JP) ..... 9-202479

(51) Int. Cl.[7] ..... B05D 5/04; B41M 5/00

(52) U.S. Cl. ..... 427/394; 427/301; 427/341; 427/342; 427/389.9; 347/105; 442/60; 442/108; 428/311.11; 428/365

(58) Field of Search ..... 442/108, 152, 442/164, 60, 63, 76, 77; 428/195, 311.11, 365; 347/105, 96; 427/301, 302, 322, 341, 342, 384, 389.9, 394

(56) References Cited

U.S. PATENT DOCUMENTS

| | | | | |
|---|---|---|---|---|
| 4,222,740 | * | 9/1980 | Bohrn et al. | 8/448 |
| 4,786,288 | | 11/1988 | Handa et al. | 8/495 |
| 5,468,553 | * | 11/1995 | Koike et al. | 428/224 |
| 5,476,540 | | 12/1995 | Shields et al. | 106/20 R |
| 5,698,478 | * | 12/1997 | Yamamoto et al. | 442/153 |
| 5,738,932 | * | 4/1998 | Kondo et al. | 428/195 |
| 5,976,673 | * | 11/1999 | Aoki | 428/195 |

FOREIGN PATENT DOCUMENTS

| | | |
|---|---|---|
| 63-31594 | 6/1988 | (JP) . |
| 63-52151 | 10/1988 | (JP) . |
| 8-209049 | 8/1996 | (JP) . |

* cited by examiner

*Primary Examiner*—Marie Yamnitzky
(74) *Attorney, Agent, or Firm*—Flynn, Thiel, Boutell & Tanis, P.C.

(57) ABSTRACT

A cloth for ink jet printing, fabricated by providing a low density cloth with a sizing agent of the gel-transition type, gel-initiating agent, and ink receiving agent for filling up gaps between fibers, and by drying the low density cloth so that even in the case where the ink-jet printing process is applied to such a low density cloth as a loosely woven or knitted fabric, a clear image can be printed thereon without ink striking through gaps between fibers, and without causing the cloth to be stained. For the low density cloth, a cloth of a single yarn weight fineness of 100 d or less, and a woven or knitted fabric of a warp density of 120 warps or less/inch or a filling density of 150 fillings or less/inch are suitable. With the use of the cloth, an ink-jet printed fabric deep in color as well as abundantly expressive of gradation (that is, having a wide range of color strength) can be obtained while preventing ink from passing through, and supporting members and the cloth from being stained.

10 Claims, 3 Drawing Sheets

CLOTH FOR INK-JET PRINTING, METHOD OF FABRICATING SAME, AND METHOD OF INK-JET PRINTING SAME

BACKGROUND OF THE INVENTION

1. Field of the Invention

This invention relates to a cloth, and particularly, to a cloth for ink-jet printing, a method of fabricating the same and further to a process of ink-jet printing using the same, wherein clear-cut printed images can be obtained thereon without ink passing through gaps between fibers, even if the cloth is a cloth of a loose texture (referred to hereinafter as a low density cloth) such as a low density woven or knitted fabric, and the like.

2. Description of the Related Art

For an ink jet printing, a so-called pretreatment process wherein an ink-receiving layer is provided on a cloth, and also, an improvement in the ink itself have been put into practice in an attempt to obtain clear-cut images without ink bleeding.

There have been developed, for example, a cloth wherein an ink-holding layer composed of a non-dyeable material selected from the group consisting of a water-soluble polymer, water-soluble salts, and water-insoluble organic fine particles is formed to absorb discharged ink for temporarily holding the ink therein so that the ink can be prevented from bleeding, and a method of dyeing the same (Japanese Patent Publication No. S63-31594), a method of ink-jet dyeing whereby ink blended with a gelling and sizing agent is injected onto a fiber structure pretreated with a gelling agent (Japanese Patent Publication No. S63-52151), and a printing process wherein a first compound contains a gel-forming species while a second compound contains a gelling initiation species, and at least either of the compounds contains a coloring agent such that the bleeding of color can be inhibited between adjacent coloring regions in the respective compounds (Japanese Patent Laid-open Publication No. H8-209049).

All of these conventional techniques, however, have been found effective for a cloth such as a woven or knitted fabric fabricated of threads with a weight fineness of not less than about 150 denier (d), a close-woven or close-knitted fabric (high density fabric) of a warp density of not less than about 120 warps/inch, or a filling density of not less than about 150 fillings/inch, and the like but not so effective for a low density cloth such as a woven or knitted fabric fabricated of threads with a weight fineness of less than about 150 denier (d), a relatively coarse-woven or coarse-knitted fabric of a warp density of less than about 120 warps/inch, or filling density of less than about 150 fillings/inch, and the like.

More specifically, there has arisen a problem that ink passes through gaps between fibers before achieving an object of obtaining clear-cut images without ink bleeding.

More particularly, when conventional ink-jet dyeing methods are applied to a low density cloth having large gaps between the fibers thereof, only a small portion of the ink injected on the surface of the cloth stays on the fibers, allowing a greater part of the ink to pass through (strike through) the gaps between the fibers.

This renders the ink utilization ratio very low, and more importantly, creates a cumbersome problem of the ink passing through the gaps between the fibers reaching and contaminating (stains) the surface of a drum for holding the cloth, thereby causing the ink remaining on the surface of the drum to contaminate a newly arrived cloth.

Therefore, preventing ink from passing through the gaps has been an important issue.

SUMMARY OF THE INVENTION

It is therefore an object of the invention to provide a cloth for ink-jet printing, a method of fabricating the same and further, to a process of printing the same, wherein clear-cut images can be printed thereon without causing the ink to pass therethrough and the cloth to be stained, even when an ink-jet process is applied, particularly, to a low-density cloth such as a coarse-woven, coarse-knitted fabric or the like.

The invention has been provided to solve the aforesaid problems as described hereinafter.

An object of the invention is to provide a cloth for ink-jet printing, obtained by providing a low-density cloth with a sizing agent of a gel-transition type (sizing agent capable of transition from a sol to a gel state), gelling agent, and ink-holding agent to fill up the gaps between the fibers, and by drying the low-density cloth (1).

Another object of the invention is to provide the cloth for ink-jet printing according to (1) above, wherein the low-density cloth is a cloth fabricated of threads with a weight fineness of not more than 150 d(2).

A still further object of the invention is to provide the cloth for ink-jet printing according to (1) above, wherein the low-density cloth is a woven or knitted fabric of a warp density of not more than 120 warps/inch, or a filling density of not more than 150 fillings/inch (3).

A further object of the invention is to provide the cloth for ink-jet printing according to (1), (2), or (3) above, wherein the sizing agent of the gel-transition type is one type or not less than two types of sizing agents of the gel-transition type selected from the group consisting of a water-soluble cellulose substance such as carboxymethyl cellulose, a polysaccharide such as sodium alginate, gum arabic, and locust bean gum, and a water-soluble synthetic polymer such as polyvinyl alcohol, polyalkylene oxide, and water-soluble acrylic resin (4).

A still further object of the invention is to provide the cloth for ink-jet printing according to (1), (2), or (3) above, wherein the gel-initiating agent is one type or not less than two types of gelling agents selected from the group consisting of calcium chloride, potassium chloride, barium chloride, magnesium chloride, stannous chloride, stannic chloride, cupric chloride, calcium hydroxide, aluminum sulfate, zinc sulfate, chromium nitrate, silver nitrate, aluminum acetate, ferrous sulfate, ferric chloride, boric acid, borax, tannic acid, and the like (5).

A yet further object of the invention is to provide a method of fabricating a cloth for ink-jet printing, comprising the steps of filling up gaps between fibers by providing a low density cloth with a sizing agent of the gel-transition type, gelling agent, and ink-holding agent, and drying the low-density cloth (6).

Further, an object of the invention is to provide a method of fabricating a cloth for ink-jet printing, comprising the steps of filling up the gaps between the fibers by providing a low-density cloth with a gelling agent first, and with a treatment agent containing a sizing agent of the gel-transition type and an ink-holding agent thereafter, and drying the low-density cloth (7).

Another object of the invention is to provide a method of fabricating a cloth for ink-jet printing, comprising the steps of filling up gaps between the fibers by providing a low-density cloth with a gelling agent, sizing agent of the gel-transition type, and an ink-holding agent, in sequence, and drying the low density cloth (8).

Still another object of the invention is to provide a method of fabricating a cloth for ink-jet printing, comprising the steps of filling up gaps between fibers by providing a low density cloth with a sizing agent of the gel-transition type first, and with a treatment agent containing a gelling agent and ink-holding agent thereafter, and drying the low density cloth (9).

A further object of the invention is to provide a method of fabricating a cloth for ink-jet printing, comprising the steps of filling up gaps between the fibers by providing a low density cloth with a sizing agent of the gel-transition type, gelling agent, and ink-holding agent, in sequence, and drying the low density cloth (10).

A still further object of the invention is to provide a process of ink-jet printing a cloth for ink-jet printing, fabricated by providing a low density cloth with a sizing agent of the gel-transition type, gelling agent, and ink-holding agent to fill up gaps between the fibers, and by drying the low density cloth, whereby a pattern is ink-jet printed thereon, and the dye fixed thereon (11).

A yet further object of the invention is to provide the process of ink-jet printing a cloth for ink-jet printing according to (11) above, wherein the low density cloth is a cloth fabricated of threads with a weight fineness of not more than 150 denier or a woven or knitted fabric of a warp density of not more than 120 warps/inch or a filling density of not more than 150 fillings/inch (12).

DESCRIPTION OF THE PREFERRED EMBODIMENTS

Figure 1:
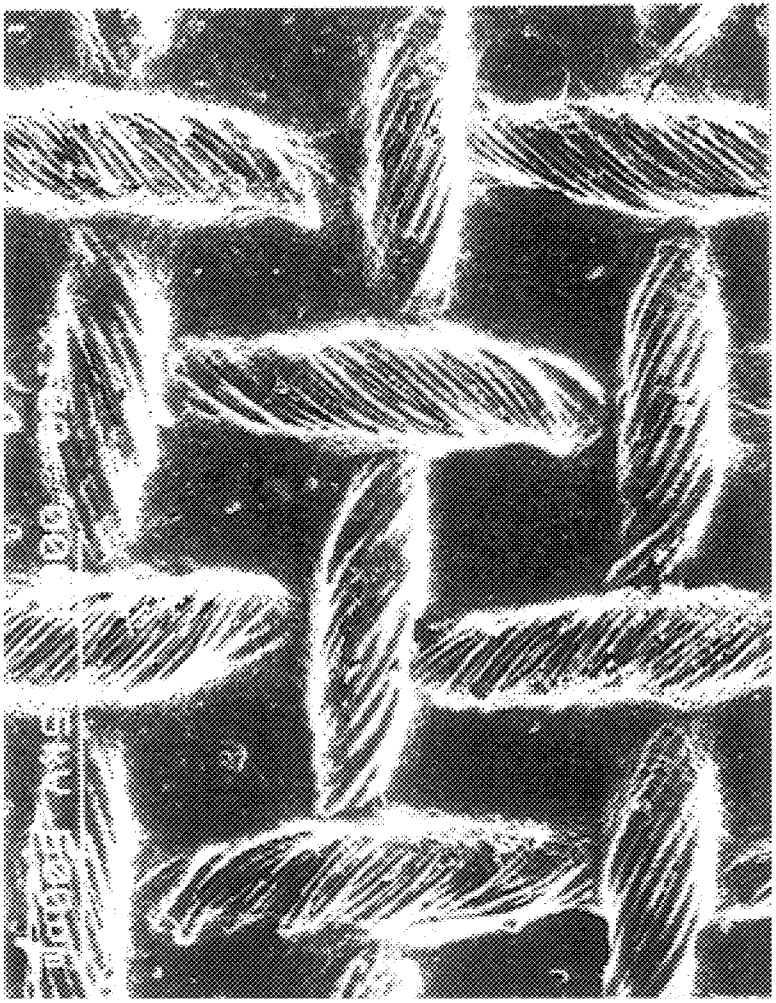
FIG. 1 is an electron micrograph of a cloth of polyester Georgette crepe for ink-jet printing according to the invention.

The present invention provides a cloth for ink-jet printing, obtained by providing a low-density cloth with a sizing agent of the gel-transition type, gelling agent, and ink-holding agent so as to fill up gaps between the fibers, and by drying the low-density cloth, and a method of fabricating the same.

The cloth for ink-jet printing as described above is fabricated by the following methods (1) to (4):

a fabrication method (1) comprising the steps of filling up gaps between the fibers by providing a low density cloth with a gelling agent first and with a treatment agent containing a sizing agent of the gel-transition type, and ink-holding agent thereafter, and drying the low-density cloth;

a fabrication method (2) comprising the steps of filling up gaps between the fibers by providing a low density cloth with a gelling agent, sizing agent of the gel-transition type, and ink-holding agent, in sequence, and drying the low density cloth;

a fabrication method (3) comprising the steps of filling up the gaps between the fibers by providing a low density cloth with a sizing agent of the gel-transition type first and with a treatment agent containing a gelling agent and ink-holding agent thereafter, and drying the low density cloth; and a fabrication method (4) comprising the steps of filling up the gaps between the fibers by providing a low density cloth with a sizing agent of the gel-transition type, gelling agent, and ink-holding agent, in sequence, and drying the low density cloth.

The invention further provides a process of ink-jet printing, comprising the steps of ink-jet printing a pattern on the cloth for ink-jet printing as described above, and developing a color.

First, the methods of fabricating the cloth for ink-jet printing according to the invention, comprising the steps of filling up the gaps between the fibers by providing a low density cloth with the sizing agent of the gel-transition type, gelling agent and ink-holding agent, and drying the low density cloth are specifically described hereinafter.

In the aforesaid methods according to the invention, the sequence and combination of the respective treatment agents such as the sizing agent of the gel-transition type, gelling agent and ink-holding agent, applied to the low density cloth, may be varied variously as described below and various additives may be used by adding the same to the respective treatment agents.

The sequence in which the respective treatment agents are applied to the low density cloth can be broadly classified into two cases as follows:

1) a case where the low density cloth is first provided with the gelling agent, and subsequently, with the sizing agent of the gel-transition type, and ink-holding agent (the cases of the fabrication methods (1) and (2) described above).

2) a case where the low density cloth is first provided with the sizing agent of the gel-transition type, and subsequently, with the gelling agent, and ink-holding agent (the cases of the fabrication methods (3) and (4) described above).

The fabrication methods (1) and (2) are carried out by providing the low density cloth first with the gelling agent (or a gelling agent compound containing a sizing agent which does not undergo gelation by the gelling agent), and subsequently, with a treatment agent containing the sizing agent of the gel-transition type and ink-holding agent, or with the sizing agent of the gel-transition type and ink-holding agent, in sequence.

The fabrication methods (3) and (4) are carried out by providing the low density cloth first with the sizing agent of the gel-transition type, and subsequently, with a treatment agent containing the gelling agent and ink-holding agent, or with the gelling agent and ink-holding agent, in sequence.

Among the fabrication methods described above, the method (1) is a particularly preferable method.

The reason for this is that in the case of the fabrication method (3) wherein the treatment agent containing the gelling agent and ink-holding agent is used, the availability of a material (sizing agent) suitable for the ink-holding agent, not reacting with the gelling agent and yet having an ink-holding capability is limited, and as opposed to the cases of the fabrication methods (2) and (4) wherein a step of providing the ink-holding agent is required in addition to a step of providing the gelling agent, resulting in an increase in the number of processing steps, the fabrication method (1) is not only free from such drawbacks as described above but also has an advantage over the other methods in that one and the same sizing agent having both a gel-transition characteristic and ink-holding capability can be used.

For the sizing agent of the gel-transition type for use in embodying the invention, use is made of a water-soluble cellulose substance such as carboxymethyl cellulose, a polysaccharide such as sodium alginate, gum arabic, locust bean gum, and a water-soluble polymer such as polyvinyl alcohol, polyalkylene oxide, water-soluble acrylic resin, and the like.

Further, one type or not less than two types of sizing agents of the gel-transition type selected from the group consisting of the aforesaid substances can be put to use.

The sizing agent of the gel-transition type for use in embodying the invention is composed primarily of a water-soluble polymer and water, however, it is desirable to use a compound blended with a leveling agent such as octyl alcohol, a micropore-forming agent, softening agent such as urea, ink permeator such as glycerin, and the like as necessary to an extent that gelation is not inhibited.

For the gelling agent for use in embodying the invention, use is made of calcium chloride, potassium chloride, barium chloride, magnesium chloride, stannous chloride, stannic chloride, cupric chloride, calcium hydroxide, aluminum sulfate, zinc sulfate, chromium nitrate, silver nitrate, aluminum acetate, ferrous sulfate, ferric chloride, boric acid, borax, tannic acid, and the like.

Further, one type or not less than two types of gel-initiating agents selected from the group consisting of the aforesaid substances can be put to use.

The gel-initiating agent described above is composed of a sizing agent which does not undergo gelation by the gelling agent (referred to hereinafter as the sizing agent unless otherwise described, and used in this instance for providing a gelling agent compound with viscosity) and a solvent (water), however, it is desirable to blend therewith various additives including a leveling agent such as octyl alcohol, a micropore forming agent, a softening agent such as urea, ink permeator such as glycerin, and the like as necessary.

For the sizing agent mixed in the gelling agent compound, a sizing agent which does not result in the combination of the sizing agent of the gel-transition type and the gelling agent as described hereinafter is selected, and generally, a substance other than such a sizing agent containing in the molecule thereof large amounts of COOM (M denoting alkaline metal) group and OH group as is able to form a coordinate bond with multicharged metal ions of the gelling agent is selected for use as necessary.

By way of examples of combination of the gel-initiating agent with the sizing agent, there are cited combinations of the gelling agent selected from the group consisting of calcium chloride, barium chloride, stannous chloride, stannic chloride, calcium hydroxide, aluminum sulfate, zinc sulfate, chromium nitrate, silver nitrate, aluminum acetate, ferrous sulfate, ferric chloride, and the like with the sizing agent selected from the group consisting of methyl cellulose, hydroxy ethyl cellulose, alginic acid propylene glycol, and the like.

For the micropore forming agent described above, use can be made of an aromatic hydrocarbon such as toluene, xylene, a hydrocarbon such as industrial gasoline no. 4, 5, a hydrocarbon halide such as chlorobenzene, dichlorobenzene, and an ester such as butyl acetate, acrylic acid butyl, and the like.

Further, one type or not less than two types of micropore forming agents selected from the group consisting of the aforesaid substances can be put to use.

In particular, when the micropore forming agent is added, ink passing through the formed pores is held in regions close to the fibers, enhancing the degree of exhaustion (color depth).

It is desirable to add the micropore forming agent because the pores formed in a gel layer can store ink when a large amount of ink is discharged through a jet nozzle, preventing the ink that is unable to pass through the gel layer from flowing from side to side, and from contaminating (staining) fibers in regions other than the target regions.

Preferable examples of combinations of the sizing agent of the gel-transition type and the gelling agent for use in [embodying] the invention are as follows:

sodium alginate: calcium chloride, potassium chloride, barium chloride, magnesium chloride, stannous chloride, calcium hydroxide, aluminum acetate, aluminum sulfate, ferrous sulfate, ferric chloride, cupric chloride, silver nitrate, and ammonium aluminum sulfate;

carboxymethyl cellulose: potassium chloride, calcium chloride, barium chloride, magnesium chloride, calcium hydroxide, cupric chloride, stannous chloride, ferric chloride, aluminum sulfate, aluminum acetate, ferrous sulfate, and silver nitrate;

polyvinyl alcohol: boric acid, borax, aluminum sulfate, and tannic acid; and locust bean gum: borax, and tannic acid.

Among the combinations described above, the combination of sodium alginate having a high desizing property at low temperatures with calcium chloride are less likely to cause any environmental problem and are particularly preferred.

As for types of sodium alginate, there are available a guluronic acid type and mannuronic acid type, of which the guluronic acid type prone to form easily a chelate with calcium ions and having a high membrane strength is particularly preferable.

Concentration of the sizing agent of the gel-transition type varies depending on the type of the water-soluble polymer in use, and viscosity desired. If, for example, sodium alginate is used, the concentration is in the range of 0.1 to 10 wt. %, preferably, from 0.1 to 5 wt. %.

Concentration of the gelling agent also varies depending on the type of the sizing agent added thereto, and is in the range of 0.1 to 10 wt. %, preferably, from 0.1 to 5 wt. %

The ink-holding agent for use in practicing the invention consists of a non-dyeable polymer compound and a solvent for dissolving the former therein.

For the non-dyeable polymer compound, there are cited a water-soluble synthetic polymer such as polyvinyl acetate, polymethacrylate, polyacrylamide, and polyvinyl alcohol, carboxymethyl cellulose, carboxymethyl starch, gum arabic, guar gum, locust bean gum, other starches, modified starch, sodium alginate, clay material such as montmorillonite, and the like.

Further, one type or not less than two types of non-dyeable polymer compounds selected from the group consisting of the aforesaid substances can be put to use.

Further, a most suitable substance, depending on a cloth or a dyestuff, for use is selected from the group consisting of the substances described above.

As cited hereinbefore, in the preferable examples of the combination of the sizing agent of the gel-transition type and the gelling agent, such substances as sodium alginate, carboxymethyl cellulose, polyvinyl acetate, and the like can also function as the sizing agent of the gel-transition type depending on the type of the gelling agent. Accordingly, when preparing a treatment agent containing the ink-holding agent and gelling agent, a combination likely to cause such gelation should be avoided (the same applies to a case of the sizing agent being mixed in the gelling agent).

For a solvent for the above, water is mainly used, or an organic solvent is used as the case may be.

An adequate amount of a reduction inhibitor, auxiliary fixing agent, fixing reagent, fixing promoter, and the like, respectively, is added to the ink holding agent as necessary.

For the reduction inhibitor, sodium metanitrobenzenesulfonate, and the like are used.

For the auxiliary fixing agent, a neutral salt such as mirabilite, common salt, and calcium chloride, and the like are used.

For the fixing reagent, an acidic material such as acetic acid, and aluminum sulfate, or alkaline material such as sodium carbonate, and sodium hydroxide, and the like are used.

For the fixing promoter, a hydrotropic agent such as urea, thiourea, and polyethylene glycol, a carrier agent such as chlor benzene and benzoic acid, and the like are used.

Further, one type or not less than two types of respective additives described above selected from the respective groups consisting of the aforesaid substances can be put to use.

For the cloth according to the invention, a cloth of any texture, irrespective of whether it is a fabric (woven and knitted), unwoven fabric, braid, and the like, may be used, however, a woven or knitted fabric is particularly preferable.

For the material making up the cloth, use can be made of a natural fiber such as cotton, hemp, silk, and wool, regenerated fibers such as rayon, semi-synthetic fibers such as acetate fiber and triacetate fiber, and synthetic fibers such as polyester, nylon, acrylic fiber, and the like. A fabric made of more than one of the fibers described above, mixedly spun or woven, can also be used.

In this connection, the lower the density of the cloth, that is, the less the weight fineness of the threads thereof, or the density (of warp, or filling), the greater the merit of the method of the ink-jet printing according to the invention becomes in comparison with the conventional method.

As for the weight fineness of the threads, the method of the ink-jet printing is found to be considerably more effective with a cloth fabricated of threads with a weight fineness of not more than 150 denier in comparison with the conventional method, and since a cloth with a weight fineness of 30 denier or less is not normally suitable for practical use for clothing, a cloth with the weight fineness in the range of 30 to 150 denier is suitable in practicing the invention.

As for the density of the warps, the process of the ink-jet printing is considerably more effective with a cloth of a warp density of not more than 120 warps/inch in comparison with the conventional process. However, since a cloth with a warp density of 30 warps or less is not suitable for practical use for clothing, a cloth of a warp density in the range of 30 to not more than 120 warps/inch is adopted.

Further, the process of the ink-jet printing is found considerably more effective with a cloth having a density of fillings of not more than 150 fillings/inch in comparison with the conventional process. However, since a cloth with a filling density of 50 fillings or less is not normally suitable for practical use for clothing, a cloth with a filling density in the range of 50 to not more than 150 fillings/inch is adopted.

In the fabrication method according to the invention as described in the foregoing, conventional processes for treatment such as screen printing, knife coating, padding, and the like, may be adopted as means for providing the low density cloth with treatment agents such as the sizing agent of the gel-transition type, gel-initiating agent, ink-holding agent and the like. However, the screen printing process wherein the treatment agents can be held in the gaps between fibers with greater ease is particularly preferable.

After completion of a process of applying the treatment agents to the low density cloth, the cloth is dried after setting drying conditions corresponding to the kind of fiber materials making up the cloth and type of treatment agents.

The ink-jet printing adopted in embodying the invention refers to a process whereby an ink-containing dye and the like is jetted out of the nozzle of an ink-jet printer onto the surface of a cloth to effect printing on the basis of information stored beforehand. There are available such typical ink-jet printing processes as the pressure pulsation type, pressure vibration type, and electrostatic acceleration type, any of which can be adopted.

As a coloring matter for use in the ink for the jet-ink printing process, there are cited a direct dye, acid dye, basic dye, disperse dye, reactive dye, fluorescent dye, and the like, and adequate selection thereof depending on the materials making up a cloth to be printed as required.

Since the quality of a printed pattern image is greatly affected by the ink prepared for use in the ink-jet printing, adequate adjustment is therefore made in respect of the dye selection, grain size, viscosity, surface tension, pH, and the like, adding adequate amounts of a dispersing agent, anti-forming agent, and the like as necessary.

A printed cloth is then subjected to a wet heat treatment whereby the coloring matter is caused to develop a color and be fixed to the cloth, normally by steaming, and the like.

After the dye is fixed to the cloth, the printed cloth is subjected further to a cleaning treatment whereby unfixed dye, chemicals, auxiliary materials, and sizing agents are completely washed off.

By applying the cleaning process, further improvement can be attained with respect to hue, definition, colorfastness, and handle (pleasantness in the feel) of the printed cloth.

WORKING EXAMPLES

Example 1

The following is an example of the method (1) of fabricating the cloth for ink-jet printing according to the invention, that is, a method of fabricating the cloth for ink-jet printing, comprising the steps of filling up gaps between fibers by providing a low density cloth with a gelling agent first and with a treatment agent containing a sizing agent of the gel-transition type and ink-holding agent thereafter, and drying the low density cloth.

Desizing, scouring and heat setting were applied by conventional manner to a cloth of polyester georgette crepe, woven of warps made of polyester multi-filaments of 50 d/24 f and fillings made of polyester multi-filaments of 50 d/24 f at a warp density of 80 warps/inch, and filling density of 100 fillings/inch.

Subsequently, a gelling agent compound of the following composition was applied to the cloth by use of the rotary screen printing process;

| (1) components of the gelling agent compound: | |
|---|---|
| Marpolose ME - 400G(R) (sizing agent) (manufactured by Matsumoto Yushi Seiyaku Co., Ltd.) | 3.0% |
| calcium chloride (gel-initiating agent) | 5.0% |
| octyl alcohol (leveling agent) | 1.0% |
| micropore forming agent* | 15.0% |
| *mineral turpentine | 50.0% |
| Aroemulphor HS(R) (emulsifier) (manufactured by Meisei Chemical Works Co. Ltd.) | 2.0% |
| water | 48.0 |
| water | balance |
| total | 100.0% |
| | (viscosity: 15000 cps). |

Subsequently, a treatment agent containing a sizing agent of the gel-transition type and an ink-holding agent, having the following composition, was applied onto the cloth provided with the gelling agent compound described above;

| (2) components of the treatment agent containing the sizing agent of the gel-transition type and ink-holding agent; | |
|---|---|
| DUCK ALGIN NSPL(R) (sizing agent of the gel-transition type) (manufactured by Kibun FoodsChemifa Co., Ltd.) | 1.0% |
| Marpolose ME-400G(R) (ink-holding agent) (manufactured by Matsumoto Yushi Seiyaku Co. Ltd.) | 2.0% |
| malic acid (pH regulator) | 0.5% |
| MS-liq(R) (reduction inhibitor) (manufactured by Meisei Chemical Works Co. Ltd.) | 1.0% |
| octyl alcohol (leveling agent) | 1.0% |
| micropore forming agent* | 15.0% |
| water | balance |
| total | 100% |
| | (viscosity: 10000 cps). |

Thereafter, by drying the cloth at 160° C. for one minute with the use of a setter, a cloth for ink-jet printing as intended was obtained.

FIG. 1 is an electron micrograph showing the cloth for ink-jet printing.

It is evident from the figure that gaps between the fibers are filled up with gel films, having the ink-holding agents formed therein.

Figure 2:
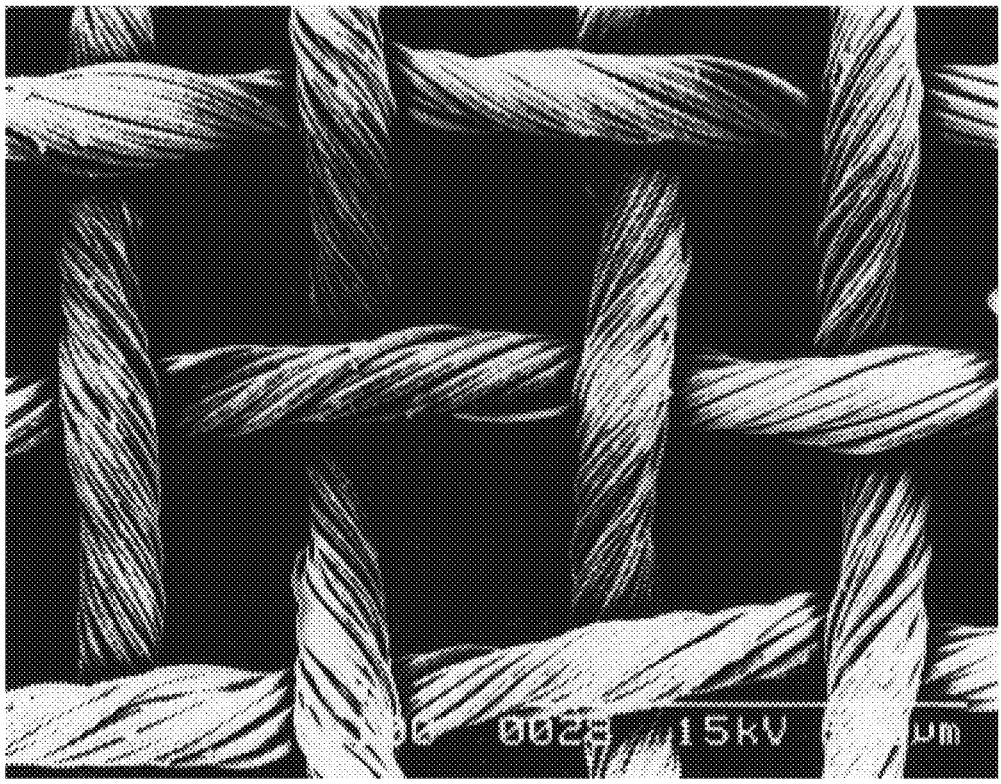
FIG. 2 is an electron micrograph of a cloth of polyester Georgette crepe used in carrying out embodiments of the invention before treatment is applied thereto.

FIG. 2 is an electron micrograph of a cloth of polyester Georgette crepe used in carrying out the example, before treatment was applied thereto, shown for reference.

Figure 3:
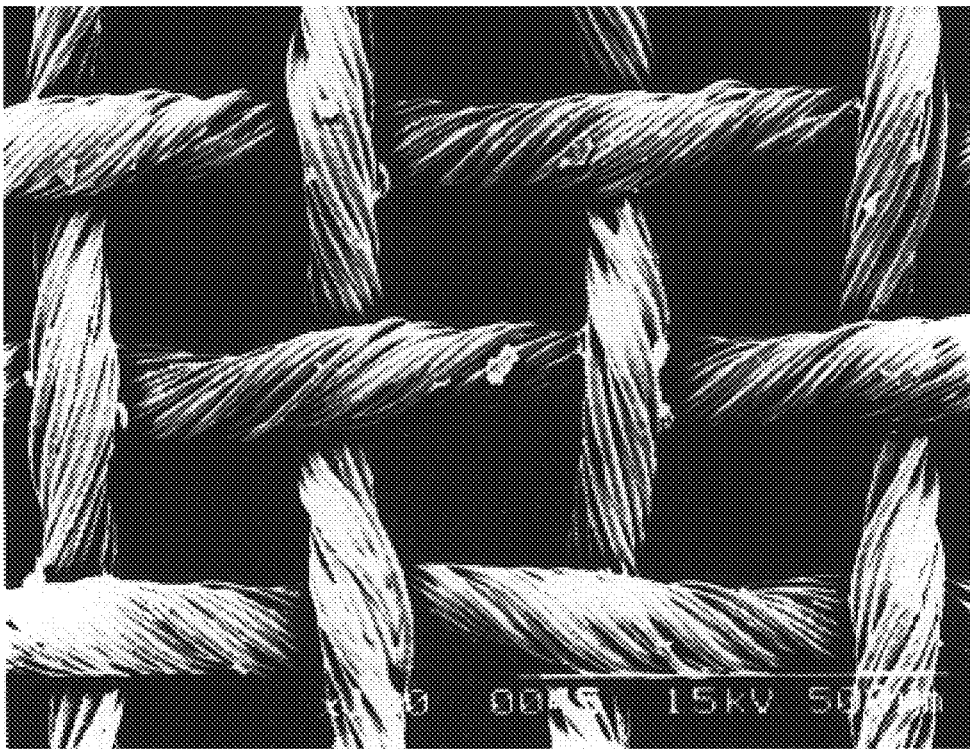
FIG. 3 is an electron micrograph of a cloth of polyester Georgette crepe provided with a conventional ink-holding agent before treatment is applied thereto.

Further, FIG. 3 is an electron micrograph showing the cloth of polyester Georgette crepe used in carrying out the example, before the treatment was applied thereto, provided with the ink-holding agent by a conventional method, that is, the cloth was provided with the ink-holding agent by means of the rotary screen printing method.

Thereafter, printing of a pattern was performed with the use of an ink of the following formulation, and the ink-jet printing process;

ink formulation:

| | |
|---|---|
| C1 Disperse Red 127 | 5 parts |
| lignin sulfonic acid salt (anionic surfactant) | 4 parts |
| Shin-Etsu Silicone KM - 70(R) (antiforming agent) (manufactured by Shin-Etsu Chemical Co., Ltd.) | 0.05 parts |
| ethylene glycol | 10.0 parts |
| silicic acid | 0.1 parts |
| water purified with ion-exchange resin | balance |
| total | 100 parts |

ink-jet printing method:

A serial scanning printer of the on-demand-type was used. Printing was performed under the conditions of the diameter of a nozzle at 100 $\mu$m, driving voltage at 107 V, power frequency 10 kHz, resolution 360 dpi, and 4×4 matrix.

For the printing design, two patterns in the form of a cross, (a) 50×50 mm, and (b) 0.5 mm wide, and 50 mm long, formed by thin lines in the directions of the warp and filling, respectively, were adopted.

Thereafter, a printed cloth was subjected to an ordinary cleaning process and drying process after applying a wet heat treatment thereto at 175° C. for 10 minutes.

The results are shown in Table 1.

A high-precision clear-cut bright and sufficiently deep color pattern was found printed on the cloth of polyester Georgette crepe with no sign of ink striking therethrough and no spots thereon.

Example 2

The following is an example of the method (4) of fabricating the cloth for ink-jet printing according to the invention, that is, the method of fabricating the cloth for ink-jet printing, comprising the steps of filling up the gaps between the fibers by providing a low density cloth with a sizing agent of the gel-transition type, gelling agent, and ink-holding agent, in sequence and drying the low density cloth.

The same cloth as used in Example 1 was provided with the sizing agent compound of the gel-transition type, gelling agent compound, and ink-holding agent compound, of the following composition, in sequence by use of the rotary screen printing process:

| (1) components of the sizing agent compound of the gel-transition type; | |
|---|---|
| DKS Fine gun-H(R) (sizing agent of the gel-transition type) (manufactured by Dai-ichi Kogyo Seiyaku Co., Ltd.) | 3.0% |
| octyl alcohol (leveling agent) | 1.0% |
| micropore forming agent* | 15.0% |
| water | balance |
| total | 100% (viscosity: 8000 cps) |

| (2) components of the gelling agent compound: | |
|---|---|
| Marpolose ME-400G(R) (sizing agent) (manufactured by Matsumoto Yushi Seiyaku Co., Ltd.) | 4.0% |
| magnesium chloride (gelling agent) | 5.0% |
| octyl alcohol (leveling agent) | 1.0% |
| micropore forming agent* | 15.0% |
| water | balance |
| total | 100% (viscosity: 11000 cps) |

| (3) components of the ink-holding agent compound: | |
|---|---|
| Marpolose ME-400G(R) (ink-holding agent) (manufactured by Matsumoto Yushi Seiyaku Co., Ltd.) | 4.0% |
| malic acid (pH regulator) | 0.5% |
| MS-liq R (reduction inhibitor) (manufactured by Meisei Chemical Works Co. Ltd.) | 1.0% |
| octyl alcohol (leveling agent) | 1.0% |
| micropore forming agent* | 15.0% |
| water | balance |
| total | 100% |

Thereinafter, as in Example 1, drying, ink-jet printing, wet heat treatment, cleaning treatment, and drying treatment were applied to the cloth.

The results are shown in Table 1.

A high-precision clear-cut pattern in bright and sufficiently deep color was found printed on the cloth of polyester Georgette crepe with no sign of ink passing therethrough and no spots thereon.

Next, examples of the method (2) of fabricating the cloth for ink-jet printing according to the invention, that is, the method of fabricating the cloth for ink-jet printing, comprising the steps of filling up gaps between fibers by providing a low density cloth with a gelling agent, sizing agent of the gel-transition type and ink-holding agent, in sequence, and drying the low density cloth, are described hereinafter with reference to Examples 3 to 5 described below.

These Examples were carried out by varying the type and the kind of a cloth, gelling agent, sizing agent of the gel-transition type, ink-holding agent, and additive.

Example 3

Scouring and heat setting were applied by a conventional manner to a cloth of nylon georgette crepe, woven of warps and fillings, made of nylon 6 threads of 75 d/36 f at a warp density of 70 warps/inch, and a filling density of 68 fillings/inch.

A gelling agent compound of the same composition as in Example 1 was applied to the cloth by means of the knife coater.

Subsequently, the cloth was provided with a sizing agent compound of the gel-transition type shown below using a knife coater.

| (1) components of the sizing agent compound of the gel-transition type: | |
|---|---|
| DUCK ALGIN NSPL(R) (sizing agent of the gel-transition type) (manufactured by Kibun Food Chemifa Co., Ltd.) | 2.5% |
| octyl alcohol (leveling agent) | 1.0% |
| micropore forming agent* | 15.0% |
| water | balance |
| total | 100% (viscosity: 8000 cps). |

The cloth was provided further with an ink-holding agent compound of the following composition using a knife coater:

| (2) components of the ink-holding agent compound: | |
|---|---|
| DKS Finegum(R) (sizing agent of the gel-transition type) (manufactured by Dai-ichi Kogyo Siyakul Co., Ltd.) | 3.0% |
| ammonium sulfate (pH regulator) | 10.0% |
| MS-liq(R) (reduction inhibitor) (manufactured by Meisei Chemical Works Ltd.) | 1.0% |
| octyl alcohol (leveling agent) | 0.5% |
| micropore forming agent* | 20.0% |
| water | balance |
| total | 100% |

After drying the cloth at 150° C. for one minute using the setter, a pattern was printed on the cloth with the use of ink of the following formulation and the ink-jet printing process; ink formulation:

| | |
|---|---|
| C1 Acid Red 6 | 5 parts |
| lignin sulfonic acid salt (anionic surfactant) | 4 parts |
| Shin-Etsu Silicone KM-70(R) (antiforming agent) (manufactured by Shin-Etsu Chemical Co., Ltd.) | 0.05 parts |
| ethylene glycol | 10.0 parts |
| silicic acid | 0.1 parts |
| water purified with ion-exchange resin | balance |
| total | 100 parts |

Thereafter, a printed cloth was subjected to an ordinary cleaning process and drying process after applying a wet heat treatment thereto at 108° C. for 20 minutes.

The results are shown in Table 1.

A high-precision bright and sufficiently deep color image was found printed on the nylon mesh cloth with no sign of ink passing therethrough and no spots thereon.

Example 4

Scouring and heat setting were applied by a conventional manner to a cloth of nylon georgette crepe, woven of warps and fillings, made of nylon 6 threads of 75 d/45 f at a warp density of 64 warps/inch, and a filling density of 64 fillings/inch.

A gelling agent compound of the same composition as in Example 1 was applied to the cloth by use of the rotary screen printing process. With the gelling agent compound of the same composition as in Example 1 by use of the rotary screen printing process.

Subsequently, the cloth was provided with a sizing agent compound of the gel-transition type of the same composition as in Example 3 by use of the rotary screen printing process.

The cloth was provided further with an ink-holding agent compound of the following composition also by use of the rotary screen printing process;

| (1) components of the ink holding compound: | |
|---|---|
| KELP ALGIN L type (R) (ink-holding agent) (manufactured by Kaisei Chemical Ind. Co., Ltd.) | 1.7% |
| soda ash (fixing reagent) | 5.0% |
| urea (fixing promoter) | 10.0% |
| MS-liq(R) (reduction inhibitor) (manufactured by Neisei Chemical Works Co., Ltd.) | 1.0% |
| octyl alcohol (leveling agent) | 0.5% |
| micropore forming agent* | balance |
| total | 100% |

After drying the cloth at 130° C. for one minute using the setter, a pattern was printed on the cloth with ink of the following formulation and using the same ink-jet printing process as in Example 1;

ink formulation:

| | |
|---|---|
| CI Direct Red 3 | 5 parts |
| lignin sulfonic acid salt (anionic surfactant) | 4 parts |
| Shin-Etsu Silicone KM - 70 (R) (antiforming agent) (manufactured by Shin-Etsu Chemical Co., Ltd.) | 0.05 parts |
| ethylene glycol | 10.0 parts |
| silicic acid | 0.1 parts |
| water purified with ion-exchange resin | balance |
| total | 100 parts |

Thereafter, a printed cloth was subjected to an ordinary cleaning process and drying process after applying a wet heat treatment thereto at 108° C. for 10 minutes.

The results are shown in Table 1.

A high-precision bright and sufficiently deep color image was found printed on the cloth of polyester Georgette crepe with no sign of ink passing therethrough and no spots thereon.

Example 5

Scouring and heat setting were applied by a conventional manner to a woolen voile cloth, woven of warps made of a 70 count single yarn and fillings made of a 70 count single yarn, with a warp density of 68 warps/inch, and a filling density of 68 fillings/inch.

Subsequently, the cloth was provided with a sizing agent compound of the gel-transition type of the same composition as in Example 3 by use of the rotary screen printing process.

The cloth was provided further with an ink-holding agent compound of the following composition also by use of the rotary screen printing process;

| (1) components of the ink-holding agent compound: | |
|---|---|
| KELP ALGIN L type (R) (ink-holding agent) (manufactured by Kaisei Chemical Ind. Co., Ltd.) | 1.7% |
| soda ash (fixing reagent) | 1.0% |
| urea (fixing promoter) | 10.0% |
| MS-liq(R) (reduction inhibitor) (manufactured by Meisei Chemical Works Co., Ltd.) | 3.0% |
| octyl alcohol (leveling agent) | 0.5% |
| micropore forming agent* | 20.0% |
| water | balance |
| total | 100% |

Then, after drying the cloth at 130° C. for one minute using the setter, a pattern was printed on the cloth with ink of the following formulation and using the same ink-jet printing process as in Example 1;

ink formulation:

| | |
|---|---|
| CI Direct Red 31 | 5 parts |
| lignin sulfonic acid salt (anionic surfactant) | 4 parts |
| Shin-Etsu Silicone KM-70 (R) (antiforming agent) (manufactured by Shin-Etsu Chemical Co., Ltd.) | 0.05 parts |
| ethylene glycol | 10.0 parts |
| silicic acid | 0.1 parts |
| water purified with ion-exchange resin | balance |
| total | 100 parts |

Thereafter, a printed cloth was subjected to an ordinary cleaning process and drying process after applying a wet heat treatment thereto at 108° C. for 20 minutes.

The results are shown in Table 1.

A high-precision clear-cut bright and sufficiently deep color pattern was found printed on the woolen voil cloth with no sign of ink passing therethrough and no spots thereon.

Example 6

A gel-initiating agent compound of the following composition was applied by use of the rotary screen printing process to the same cloth of polyester georgette crepe as used in Example 1.

| (1) components of the gelling agent compound | |
|---|---|
| Marpolose NE - 400G(R) (sizing agent) (manufactured by Matsumoto Yushi Seiyaku Co., Ltd.) | 3.0% |

-continued

| (1) components of the gelling agent compound | |
|---|---|
| calcium chloride (gel-initiating agent) | 5.0% |
| octyl alcohol (leveling agent) | 1.0% |
| glycerin (ink permeator) | 1.0% |
| water | balance |
| total | 100% |
| | (viscosity: 12000 cps) |

Subsequently, a sizing agent compound of the gel-transition type of the following composition was applied thereto also by use of the rotary screen printing process.

| (2) components of the sizing agent compound of the gel-transition type | |
|---|---|
| Kimitsu Algin 1-3G(R) (sizing agent of the gel-transition type) (manufactured by Kimitsu Chemical Industries Co., Ltd.) | 3.0% |
| octyl alcohol (leveling agent) | 1.0% |
| glycerin (ink permeator) | 1.0% |
| water | balance |
| total | 100% |
| | (viscosity: 5000 cps) |

Further, an ink-receiving agent compound of the following composition was applied thereto also by use of the rotary screen printing process.

| (3) components of the ink-holding agent compound | |
|---|---|
| Marpolose ME-400G(R) (ink-holding agent) | 2.5% |
| malic acid (pH regulator) | 1.0% |
| MS-liq R (reduction inhibitor) (manufactured by Meisei Chemical Works Co., Ltd.) | 1.0% |
| octyl alcohol (leveling agent) | 1.0% |
| glycerin (ink permeator) | 1.0% |
| water | balance |
| total | 100% |

Subsequently, the cloth was dried at 160° C. for one minute using a setter, obtaining a cloth intended for ink-jet printing.

Then, a pattern was printed on the cloth with the use of an ink of the same formulation and the same ink-jet printing process as used in Example 1.

The results are shown in Table 1.

A pattern somewhat lacking in color strength and vividness was found printed on the cloth of polyester georgette crepe, however, there was found no sign of ink passing therethrough and no spots thereon.

Example 7

A plain fabric, woven of warps made of a 70 count single yarn and fillings made of a 70 count single yarn, with a warp density of 68 warps/inch, and a filling density of 68 fillings/inch was prepared, and singeing, desizing, scouring, bleaching, and silket process were applied thereto by a conventional procedure.

Thereafter, the fabric was provided with a gel-initiating agent compound of the same composition as in Example 1 by use of the rotary screen printing process.

Subsequently, the fabric was provided with a sizing agent compound of the transition type of the same composition as in Example 3 by use of the rotary screen printing process.

The fabric was provided further with an ink-holding agent compound of the following composition also by use of the rotary screen printing process.

| (1) components of the ink-holding agent compound: | |
|---|---|
| KELP ALGIN L type (R) (ink-holding agent) (manufactured by Kaisei Chemical Ind. Co., Ltd.) | 1.7% |
| soda ash (fixing reagent) | 7.0% |
| urea (fixing promoter) | 7.0% |
| MS-liq(R) (reduction inhibitor) (manufactured by Meisei Chemical Works Co., Ltd.) | 3.0% |
| octyl alcohol (leveling agent) | 0.5% |
| micropore forming agent* | 20.0% |
| water | balance |
| total | 100% |

Then, after drying the fabric at 130° C. for one minute using the setter, a pattern was printed on the fabric with an ink of the following formulation and using the same ink-jet printing process as in Example 1.

ink formulation:

| | |
|---|---|
| CI Direct Red 3 | 5 parts |
| lignin sulfonic acid salt (anionic surfactant) | 4 parts |
| Shin-Etsu Silicone KM-70(R) (antiforming agent) (manufactured by Shin-Etsu Chemical Co., Ltd.) | 0.05 parts |
| ethylene glycol | 10.0 parts |
| silicic acid | 0.1 parts |
| water purified with ion-exchange resin | balance |
| total | 100 parts |

Thereafter, a printed fabric was subjected to an ordinary cleaning process and drying process after applying a wet heat treatment thereto at 108° C. for 20 minutes.

The results are shown in Table 1.

A high-precision clear-cut sufficiently deep color pattern was found printed on the plain fabric, and there was found no sign of ink passing therethrough and no spots thereon.

Example 8

A cloth of polyester georgette crepe, the same as used in Example 1, was prepared, and provided with a gelling agent compound of the following composition by use of the padding process.

| (1) components of the gelling agent compound: | |
|---|---|
| Marpolose ME-400G(R) (sizing agent) (manufactured by Matsumoto Yushi Seiyaku Co., Ltd.) | 1.0% |

-continued

| (1) components of the gelling agent compound: | |
|---|---|
| calcium chloride (gel-initiating agent) | 5.0% |
| octyl alcohol (leveling agent) | 1.0 |
| water | balance |
| total | 100% |
| | (viscosity: 200 cps). |

Subsequently, a treatment agent containing a sizing agent of the gel-transition type and an ink-holding agent, having the following composition, was applied by use of the rotary screen printing process onto the cloth provided with the gelling agent compound described above;

| (2) components of the treatment agent containing the sizing agent of the gel-transition type and the ink-holding agent: | |
|---|---|
| DUCK ALGIN NSPM(R) (sizing agent of the gel-transition type) (manufactured by Kibun Food Chemifa Co., Ltd.) | 1.0% |
| Marpolose NE-400G(R) (sizing agent) (manufactured by Matsumoto Yushi Siyaku Co., Ltd.) | 2.0% |
| malic acid (pH regulator) | 0.5% |
| MS-liq(R) (reduction inhibitor) (manufactured by Meisei Chemical Works Co., Ltd.) | 1.0% |
| octyl alcohol (leveling agent) | 1.0 |
| glycerin (ink permeator) | 1.0% |
| water | balance |
| total | 100% |
| | (viscosity: 5000 cps). |

Subsequently, by drying the cloth at 160° C. for one minute with the use of a setter, a cloth for ink-jet printing as intended was obtained.

Thereafter, printing of a pattern was performed with the use of an ink of the same formulation, and the same ink-jet printing process as used in Example 1.

Thereafter, a printed cloth was subjected to an ordinary cleaning process and drying process after applying a wet heat treatment thereto at 175° C. for 10 minutes.

The results are shown in Table 1.

A pattern somewhat lacking in color strength and vividness but with no sign of ink passing therethrough and no spot thereon was found printed on the polyester georgette crepe cloth.

Example 9

The following is an example of the method (3) of fabricating the cloth for ink-jet printing according to the invention, that is, the method of fabricating the cloth for ink-jet printing, comprising the steps of filling up the gaps between the fibers by providing a low density cloth with a sizing agent of the gel-transition type first and with a treatment agent containing a gelling agent and ink-holding agent thereafter, and drying the low density cloth.

Desizing, scouring and heat setting were applied by the usual methods to a cloth of polyester georgette crepe, woven of warps made of polyester multi-filaments of 30 d/36 f and fillings made of polyester multi-filaments of 30 d/36 f at a warp density of 80 warps/inch, and filling density of 100 fillings/inch.

Subsequently, a sizing agent compound of the gel-transition type of the following composition was applied to the cloth by use of the rotary screen printing process.

| (1) components of the sizing agent compound of the gel-transition type | |
|---|---|
| DUCK ALGIN NSPL(R) (sizing agent of the gel-transition type) (manufactured by Kibun Food Chemifa Co., Ltd.) | 1.0% |
| malic acid (pH regulator) | 0.5% |
| MS-liq(R) (reduction inhibitor) (manufactured by Meisei Chemical Works Ltd.) | 1.0% |
| octyl alcohol (leveling agent) | 1.0% |
| micropore forming agent* | 40.0% |
| water | balance |
| total | 100% |
| | (viscosity: 10000 cps). |

Subsequently, a treatment agent containing a gel-initiating agent and ink-holding agent, having the following composition, was applied onto the cloth provided with the sizing agent compound of the gel-transition type described above

| (2) components of the treatment agent containing a gel-initiating agent compound and ink-holding agent: | |
|---|---|
| Mapolose ME-400G(R) (ink-holding agent) (manufactured by Matsumoto Yushi Seiyaku Co., Ltd.) | 3.0% |
| calcium chloride (gel-initiating agent) | 5.0% |
| octyl alcohol (leveling agent) | 1.0% |
| micropore forming agent* | 30.0% |
| water | balance |
| total | 100% |
| | (viscosity: 12000 cps). |

Thereafter, by drying the cloth at 160° C. for one minute with the use of a setter, a cloth for ink-jet printing as intended was obtained.

Thereafter, the cloth was ink-jet printed after the wet heat treatment, cleaning and drying treatments as in Example 1 were applied thereto.

The results are shown in Table 1.

A high-precision clear-cut pattern satisfactory in color strength was found printed on the cloth of polyester georgette crepe with no sign of ink passing therethrough and no spots thereon.

COMPARATIVE EXAMPLES

Comparative Examples 1 to 4

Comparative Example 1 represents a case where, in Example 2, a pattern was printed on a cloth provided with only the ink-holding agent compound without use of the sizing agent compound of the gel-transition type, and the gelling agent compound. Comparative Examples 2 to 4 represent cases where, in Examples 3 to 5, respectively, a pattern was printed on a cloth provided with only the ink-holding agent compound without use of the sizing agent compound of the gel-transition type, and the gelling agent compound.

With the use of the cloth for ink-jet printing, the method of fabricating the same, and the process of ink-jet printing using the same, according to the invention, an ink-jet printed fabric deep in color and abundantly expressive in gradation (that is, having a wide range of color strength) is obtained from printing on a low density cloth without causing the ink to pass therethrough while preventing contamination of the supporting members and the cloth.

TABLE 1

| | Printed Condition Of Finished Cloth | | | |
|---|---|---|---|---|
| | ink striking through gaps between fibers | uneven on the surface of printed cloth | resolution of patterned image | color depth |
| Example 1 | ○ | ○ | ○ | ○ |
| Example 2 | Δ ~ ○ | ○ | ○ | ○ |
| Example 3 | ○ | ○ | ○ | Δ ~ ○ |
| Example 4 | ○ | ○ | ○ | Δ ~ ○ |
| Example 5 | ○ | ○ | ○ | Δ ~ ○ |
| Example 6 | ○ | ○ | Δ | Δ |
| Example 7 | ○ | ○ | ○ | ○ |
| Example 8 | ○ | ○ | Δ | Δ |
| Example 9 | ○ | Δ ~ ○ | ○ | Δ ~ ○ |
| Comparative Example 1 | X | Δ | Δ | X ~ Δ |
| Comparative Example 2 | X | X ~ Δ | Δ | Δ |
| Comparative Example 3 | X | X ~ Δ | Δ | Δ |
| Comparative Example 4 | X | X ~ Δ | Δ | Δ |

Remark:
ink striking through gaps between fibers ○ . . . very little Δ . . . some X . . . much
uneven on the surface of printed cloth ○ . . . very few Δ . . . some X . . . many
resulotion of patterned image ○ . . . clear Δ . . . clear in part X . . . lacking in clearness
color depth ○ . . . sufficiently high Δ . . . slightly insufficient X . . . insufficient

What is claimed is:

1. A method of fabricating a cloth for ink-jet printing comprising the steps of providing a cloth having threads with a weight fineness of not more than 150 denier and formed from a woven or knitted fabric having a warp density of not more than 120 warps/inch or a filling density of not more than 150 fillings/inch, filling gaps between fibers contained in the cloth sequentially with a gelling agent first, then with a gel-transition sizing agent and finally with an ink-holding agent and drying the cloth.

2. A method according to claim 1, wherein the sizing agent is at least one member selected from the group consisting of a water-soluble cellulose substance, a polysaccharide and a water-soluble synthetic polymer.

3. A method according to claim 1, wherein the sizing agent comprises sodium alginate and the gelling agent comprises calcium chloride.

4. A method of fabricating a cloth for ink-jet printing comprising the steps of providing a cloth having threads with a weight fineness of not more than 150 denier and formed from a woven or knitted fabric having a warp density of not more than 120 warps/inch or a filling density of not more than 150 fillings/inch, filling gaps between fibers contained in the cloth sequentially with a gel-transition sizing agent first, then with a gelling agent and finally with an ink-holding agent and drying the cloth.

5. A method according to claim 4, wherein the sizing agent is at least one member selected from the group consisting of a water-soluble cellulose substance, a polysaccharide and a water-soluble synthetic polymer.

6. A method according to claim 4, wherein the sizing agent comprises sodium alginate and the gelling agent comprises calcium chloride.

7. A process for ink-jet printing a cloth comprising the steps of providing a cloth having threads with a weight fineness of not more than 150 denier and formed from a woven or knitted fabric having a warp density of not more than 120 warps/inch or a filling density of not more than 150 fillings/inch and a gel-transition sizing agent, a gel-initiating agent and ink-holding agent provided in gaps between fibers contained in the cloth, drying the cloth, applying a dye composition onto the cloth by ink-jet printing and fixing the dye composition on the cloth.

8. A process according to claim 7, wherein the sizing agent is at least one member selected from the group consisting of a water-soluble cellulose substance, a polysaccharide and a water-soluble synthetic polymer.

9. A process according to claim 7, wherein the gel-initiating agent comprises at least one member selected from the group consisting of calcium chloride, potassium chloride, barium chloride, magnesium chloride, stannous chloride, stannic chloride, cupric chloride, calcium hydroxide, aluminum sulfate, zinc sulfate, chromium nitrate, silver nitrate, aluminum acetate, ferrous sulfate, ferric chloride, boric acid, borax and tannic acid.

10. A process according to claim 7, wherein the sizing agent comprises sodium alginate and the gel-initiating agent comprises calcium chloride.

* * * * *